US009506438B2

(12) United States Patent
Inomata et al.

(10) Patent No.: US 9,506,438 B2
(45) Date of Patent: Nov. 29, 2016

(54) SUPPORT STRUCTURE FOR FUEL INJECTION VALVE

(71) Applicant: KEIHIN CORPORATION, Shinjuku-Ku, Tokyo (JP)

(72) Inventors: Yutaka Inomata, Tochigi (JP); Atsushi Kamahora, Tochigi (JP); Yuzuru Sasaki, Tochigi (JP); Takahiro Yasuda, Tochigi (JP)

(73) Assignee: Keihin Corporation, Tokyo (JP)

( * ) Notice: Subject to any disclaimer, the term of this patent is extended or adjusted under 35 U.S.C. 154(b) by 360 days.

(21) Appl. No.: 14/069,796

(22) Filed: Nov. 1, 2013

(65) Prior Publication Data

US 2014/0123926 A1 May 8, 2014

(30) Foreign Application Priority Data

Nov. 5, 2012 (JP) ..... 2012-243865

(51) Int. Cl.
*F02M 61/12* (2006.01)
*F02M 55/02* (2006.01)
*F02M 61/14* (2006.01)

(52) U.S. Cl.
CPC ..... *F02M 61/12* (2013.01); *F02M 55/025* (2013.01); *F02M 61/14* (2013.01)

(58) Field of Classification Search
CPC .... F02M 55/025; F02M 55/02; F02M 61/12; F02M 61/14; F02M 2200/853; F02M 2200/85; F02M 2200/851; F02M 2200/852; F02M 2200/855; F02M 2200/856; F02M 2200/857
USPC ..... 123/188.1–188.3, 294, 296, 445, 447, 123/456–461, 468, 469, 470, 472; 239/88–96, 533.2–533.12, 584–585.5, 239/600
See application file for complete search history.

(56) References Cited

U.S. PATENT DOCUMENTS 4,974,312 A 12/1990 Yokoyama et al.
4,993,390 A * 2/1991 Ono ..... F02M 55/004 123/456

(Continued)

FOREIGN PATENT DOCUMENTS

CN 2651457 Y 10/2004
CN 102046958 A 5/2011

(Continued)

OTHER PUBLICATIONS

Official Communication dated Aug. 25, 2015 issued in the corresponding German Patent Application 10 2013 221 934.2.

(Continued)

*Primary Examiner* — Carl Staubach
(74) *Attorney, Agent, or Firm* — Carrier Blackman & Associates, P.C.; William D. Blackman; Jingli Wang

(57) ABSTRACT

In a fuel injection valve support structure, a pair of contact surfaces are formed on an intermediate portion of the valve so as to be opposite to each other with a plane therebetween, the plane including a center axis of the valve and a center line of a coupler, the elastic support member includes a base plate placed on a second load receiving portion, an elastic piece extending from the base plate, coming into pressure contact with a fuel supply cap elastically, and biasing the valve against an engine by a reaction force resulting from the contact, and a pair of rotation locking pieces extending from the base plate and coming into contact with the respective contact surfaces to restrict rotation of the valve about the axis, and at least one of the contact surfaces has a positioning groove for elastically engaging corresponding one of the rotation locking pieces.

2 Claims, 5 Drawing Sheets

(56) References Cited

U.S. PATENT DOCUMENTS

| | | | | |
|---|---|---|---|---|
| 5,058,554 | A * | 10/1991 | Takeda | F02M 51/005 123/456 |
| 5,074,269 | A * | 12/1991 | Herbon | F02M 55/004 123/456 |
| 5,724,946 | A * | 3/1998 | Franchitto | F02M 69/465 123/468 |
| 5,820,168 | A * | 10/1998 | De Giacomoni | F16L 3/00 248/56 |
| 5,970,953 | A | 10/1999 | Lorraine et al. | |
| 6,148,797 | A | 11/2000 | Gmelin | |
| 6,199,538 | B1 | 3/2001 | Aota et al. | |
| 6,276,339 | B1 * | 8/2001 | Shebert, Jr. | F02M 61/14 123/470 |
| 6,481,420 | B1 * | 11/2002 | Panasuk | F02M 55/004 123/469 |
| 7,210,462 | B2 * | 5/2007 | Scheffel | F02M 35/10 123/470 |
| 7,406,946 | B1 * | 8/2008 | Watanabe | F02M 55/005 123/456 |
| 7,802,559 | B2 * | 9/2010 | Furst | F02M 61/14 123/470 |
| 7,931,007 | B2 | 4/2011 | Fischer et al. | |
| 8,707,930 | B2 * | 4/2014 | Bolz | F02M 55/004 123/470 |
| 8,757,128 | B2 * | 6/2014 | Fischer | F02M 61/14 123/294 |
| 9,032,934 | B2 * | 5/2015 | Nakamura | F02M 69/04 123/445 |
| 9,109,563 | B2 * | 8/2015 | Roseborsky | F02M 61/14 |
| 9,115,679 | B2 * | 8/2015 | Roseborsky | F02M 61/14 |
| 9,212,641 | B2 * | 12/2015 | Nakamura | F02M 55/02 |
| 2002/0100456 | A1 * | 8/2002 | Panasuk | F02M 55/004 123/456 |
| 2007/0007477 | A1 | 1/2007 | Hamada et al. | |
| 2008/0302336 | A1 | 12/2008 | Fuerst et al. | |
| 2009/0007886 | A1 | 1/2009 | Akabane et al. | |
| 2009/0056674 | A1 * | 3/2009 | Furst | F02M 61/14 123/470 |
| 2009/0184512 | A1 * | 7/2009 | Giorgetti | F02M 61/14 285/24 |
| 2010/0012093 | A1 * | 1/2010 | Pepperine | F02M 55/004 123/470 |
| 2010/0300406 | A1 * | 12/2010 | Harvey | F02M 55/025 123/456 |
| 2011/0186016 | A1 * | 8/2011 | Bolz | F02M 55/004 123/470 |
| 2012/0031997 | A1 * | 2/2012 | Harvey | F02M 55/005 239/289 |
| 2012/0247426 | A1 * | 10/2012 | Roseborsky | F02M 61/14 123/470 |
| 2013/0192565 | A1 * | 8/2013 | Roseborsky | F02M 61/14 123/470 |
| 2013/0220276 | A1 * | 8/2013 | Nakamura | F02M 69/04 123/470 |
| 2013/0220277 | A1 * | 8/2013 | Nakamura | F02M 55/02 123/470 |
| 2014/0123933 | A1 * | 5/2014 | Okamoto | F02M 51/0671 123/294 |
| 2014/0123952 | A1 * | 5/2014 | Yasuda | F02M 61/14 123/470 |
| 2015/0013643 | A1 * | 1/2015 | Serra | F02M 61/168 123/470 |

FOREIGN PATENT DOCUMENTS

| | | | |
|---|---|---|---|
| CN | 102076955 | A | 5/2011 |
| CN | 102734027 | A | 10/2012 |
| DE | 102005013981 | A1 | 9/2006 |
| DE | 102005020380 | A1 | 11/2006 |
| DE | 10 2010 017725 | A1 | 1/2012 |
| EP | 1 892 408 | A1 | 2/2008 |
| JP | 2001-511867 | A | 8/2001 |
| JP | 2004-245168 | A | 9/2004 |
| JP | 2007298066 | A | 11/2007 |
| JP | 2010-168964 | A | 8/2010 |
| JP | 2010-168965 | A | 8/2010 |
| JP | 2011-501020 | A | 1/2011 |
| JP | 2011099456 | A | 5/2011 |
| JP | 2011-196293 | A | 10/2011 |

OTHER PUBLICATIONS

Official Communication dated Sep. 1, 2015 issued over the corresponding CN Patent Application 201310537588.X.

U.S. Patent and Trademark Office in co-pending U.S. Appl. No. 14/069,443.

Official communication (Decision of Granting a Patent) issued to the corresponding Japanese patent application 2012-242534, of co-pending U.S. Appl. No. 14/057,144, dated May 18, 2016.

Office Action issued in the corresponding Japanese Patent Application 2012-243865, dated Jun. 29, 2016.

Office Action issued in co-pending U.S. Appl. No. 14/057,144.

* cited by examiner 2
13
A,C
Db
D
4a
9
Da
4
18
16
16
15
S
17
20
12
5b
19
20
17
6,21
6,21
3
I
5a
8
11
2
10
E
Ec
2

SUPPORT STRUCTURE FOR FUEL INJECTION VALVE

BACKGROUND OF THE INVENTION

Field of the Invention

The present invention relates to an improvement of a support structure for a fuel injection valve in which a nozzle part in a front end section of a fuel injection valve is fitted in an injection-valve mounting hole in an engine, and a fuel supply cap of a fuel distribution tube supported on the engine is fitted on a fuel introducing part in a rear end section of the fuel injection valve, the fuel injection valve having a first load receiving portion and a second load receiving portion along an axial direction thereof, the first load receiving portion being supported on the engine, the second load receiving portion being supported on an elastic support member which receives a set load from the fuel supply cap.

Description of the Related Art

Such a support structure for a fuel injection valve is known as disclosed in Japanese Patent Application Laid-open No. 2004-245168.

SUMMARY OF THE INVENTION

The above conventional support structure for a fuel injection valve is configured by merely interposing a plate spring formed in a U-shape as an elastic support member between the fuel inject valve and the fuel supply cap. Thus, during operation of the engine, vibrations thereof may somewhat rotate the fuel injection valve about its center axis in some cases. That rotation changes a direction of fuel injection from the nozzle part of the fuel injection valve, thereby adversely affecting a combustion state of fuel inside the engine.

The present invention has been made in view of the above circumstance, and an object thereof is to provide a support structure for a fuel injection valve which can easily restrict relative rotation between the fuel injection valve and an elastic support member about a center axis of the fuel injection valve, and also stabilize an attached posture of the elastic support member to the fuel injection valve to thereby enable a fuel supply cap to be pressed against the elastic support member accurately.

In order to achieve the object, according to a first aspect of the present invention, there is provided a support structure for a fuel injection valve in which a nozzle part in a front end section of a fuel injection valve is fitted in an injection-valve mounting hole in an engine, and a fuel supply cap of a fuel distribution tube supported on the engine is fitted on a fuel introducing part in a rear end section of the fuel injection valve, the fuel injection valve having a first load receiving portion and a second load receiving portion along an axial direction thereof, the first load receiving portion being supported on the engine, the second load receiving portion being supported on an elastic support member which receives a set load from the fuel supply cap, wherein a pair of contact surfaces are formed on an intermediate portion of the fuel injection valve in such a way as to be opposite to each other with a plane therebetween, the plane including a center axis of the fuel injection valve and a center line of a coupler protruded from one side of the fuel injection valve, the elastic support member includes a base plate placed on the second load receiving portion, an elastic piece extending from the base plate, elastically coming into pressure contact with the fuel supply cap, and biasing the fuel injection valve against the engine by using a reaction force resulting from the contact, and a pair of rotation locking pieces extending from the base plate and coming into contact with the contact surfaces respectively to restrict rotation of the fuel injection valve about the center axis, and at least one of the contact surfaces has a positioning groove with which the corresponding one of the rotation locking pieces elastically engages.

According to the first aspect of the present invention, the pair of contact surfaces are formed on the intermediate portion of the fuel injection valve in such a way as to be opposite to each other with the plane therebetween, the plane including the center axis of the fuel injection valve and the center line of the coupler, and the elastic support member includes: the base plate placed on the second load receiving portion; the elastic piece extending from the base plate, elastically coming into pressure contact with the fuel supply cap, and biasing the fuel injection valve against the engine by using the reaction force resulting from the contact; and the pair of rotation locking pieces extending from the base plate and coming into contact with the contact surfaces respectively to restrict the rotation of the fuel injection valve about the center axis. Thus, with the base plate being placed on the second load receiving portion and with the elastic piece elastically coming into pressure contact with the front end surface of the fuel supply cap, the fuel injection valve is elastically clamped between the engine and the fuel supply cap. Accordingly, axial displacement of the fuel injection valve can be prevented. At the same time, with the pair of rotation locking pieces of the support member coming into contact with the pair of contact surfaces on opposite sides of the fuel injection valve in such a way as to hold the contact surfaces therebetween, relative rotation between the fuel injection valve and the elastic support member about the center axis of the fuel injection valve can be prevented. Accordingly, the direction of fuel injection from the nozzle part can be stabilized. Moreover, since at least one of the contact surfaces has the positioning groove with which the corresponding one of the rotation locking pieces elastically engages, the rotation locking piece is prevented from tilting within the positioning groove, thereby stabilizing the attached posture of the elastic support member to the fuel injection valve. Therefore, the positional relation between the fuel supply cap and the elastic support member is maintained constant. Accordingly, the pressing of the fuel supply cap against the elastic support member can be performed accurately.

According to a second aspect of the present invention, in addition to the first aspect, the positioning groove is defined between a pair of restricting protrusions protruding from the contact surface and arranged thereon side by side with a gap in between.

According to the second aspect of the present invention, the positioning groove is defined between the pair of restricting protrusions protruding from the contact surface and arranged thereon side by side with a gap in between. Accordingly, the positioning groove can be formed on the contact surface without having to reduce a thickness of a sidewall of the fuel injection valve corresponding to the contact surface.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention will be described with reference to the accompanying drawings.

Figure 1:
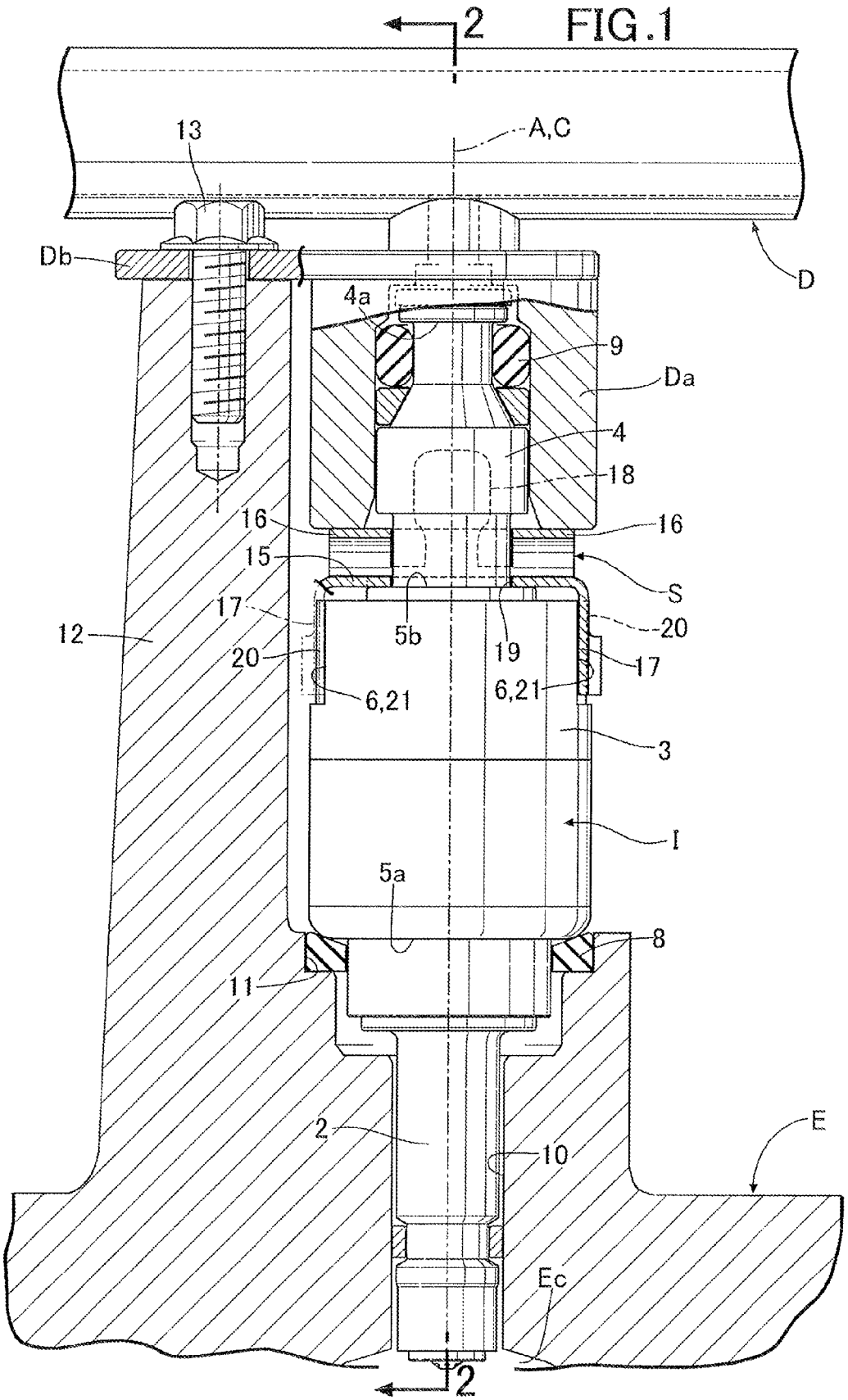
FIG. 1 is a partial longitudinal sectional elevation view showing a support structure for a fuel injection valve in an engine according to an embodiment of the present invention.
Figure 2:
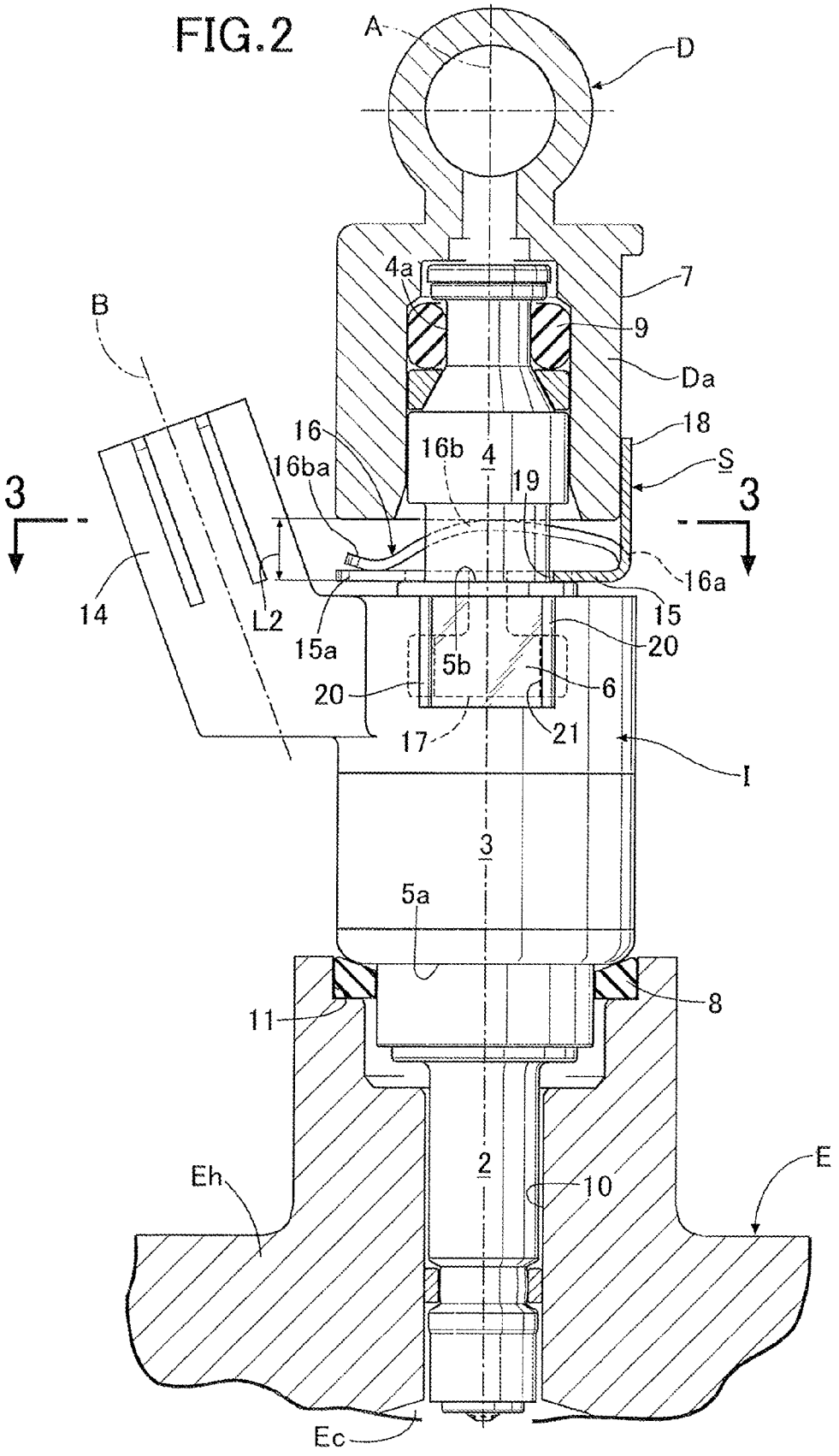
FIG. 2 is a sectional view taken along line 2-2 in FIG. 1.

First, referring to FIGS. 1 and 2, multiple fuel injection valves I each of which is capable of injecting fuel into a combustion chamber Ec in a cylinder, and a fuel distribution tube D through which fuel is distributed to the fuel injection valves I are attached to a cylinder head Eh of an engine E. Moreover, an elastic support member S is interposed between each fuel injection valve I and the fuel distribution tube D so as to prevent displacement of the fuel injection valve I either in an axial direction or about a center axis A of the fuel injection valve I. This structure will be described below in detail.

Each fuel injection valve I includes a cylindrical nozzle part 2, an electromagnetic coil part 3, and a fuel introducing part 4 aligned coaxially with each other in this order from a front end to a rear end of each fuel injection valve I. When the electromagnetic coil part 3 is energized, a valve inside the nozzle part 2 is opened, so that fuel introduced in the fuel introducing part 4 from the fuel distribution tube D is injected directly into the combustion chamber Ec from the nozzle part 2. Note that in the present invention, the nozzle part 2 side will be referred to as a front side, and the fuel introducing part 4 side will be referred to as a rear side.

The outer diameter of this fuel injection valve I becomes larger in the order of the nozzle part 2, the fuel introducing part 4, and the electromagnetic coil part 3, and thus the electromagnetic coil part 3 has a maximum outer diameter. A coupler 14 for supplying power is integrally provided on and protruding from one side surface of the electromagnetic coil part 3.

An annular first load receiving portion 5*a* is formed on a front end surface of the electromagnetic coil part 3, and an annular cushion member 8 is mounted on an outer periphery of the nozzle part 2. Moreover, an annular second load receiving portion 5*b* is formed on a rear end surface of the electromagnetic coil part 3. Further, an O-ring 9 is mounted in a seal groove 4*a* in an outer periphery of the fuel introducing part 4.

Moreover, a pair of flat first contact surfaces 6 are formed in cutout shapes on an outer peripheral surface of the electromagnetic coil part 3 in such a way as to be opposite to each other with a plane C therebetween, the plane C including the center axis A of the fuel injection valve I and a center line B of the coupler 14. A pair of restricting protrusions 20 extending in the axial direction of the fuel injection valve I and disposed side by side with a gap therebetween are formed on each first contact surface 6. Each pair of restricting protrusions 20 define a positioning groove 21 extending in an up-down direction, on the first contact surface 6.

Meanwhile, the cylinder head Eh has: injection-valve mounting holes 10 with inner ends thereof opening at ceiling surfaces of the combustion chambers Ec, respectively; and annular concave portions 11 surrounding outer opening ends of the injection-valve mounting holes 10, respectively. The nozzle part 2 of each fuel injection valve I is fitted in each injection-valve mounting hole 10, and the cushion member 8 is housed in each of the concave portions 11. Thus, the first load receiving portion 5*a* of each fuel injection valve I is supported on the cylinder head Eh with the cushion member 8 therebetween.

The fuel distribution tube D is disposed along the direction in which the multiple cylinders of the engine E are aligned, and fuel is fed under pressure from one end of the fuel distribution tube D by means of a fuel pump not shown. The fuel distribution tube D is provided with multiple fuel supply caps Da protruding from one side surface thereof and disposed along a direction in which the multiple cylinders are aligned. Each fuel supply cap Da is fitted on the outer periphery of the fuel introducing part 4 of the corresponding fuel injection valve I. In this fitted state, the O-ring 9 is in tight contact with an inner peripheral surface of the fuel supply cap Da. A flat second contact surface 7 parallel to the center axis A of the fuel injection valve I is formed on an outer side surface of the fuel supply cap Da. A bracket Db is fixedly provided to a base portion of the fuel supply cap Da. This bracket Db is fixed with a bolt 13 to a support column 12 standing upright on an upper surface of the cylinder head Eh.

Figure 3:
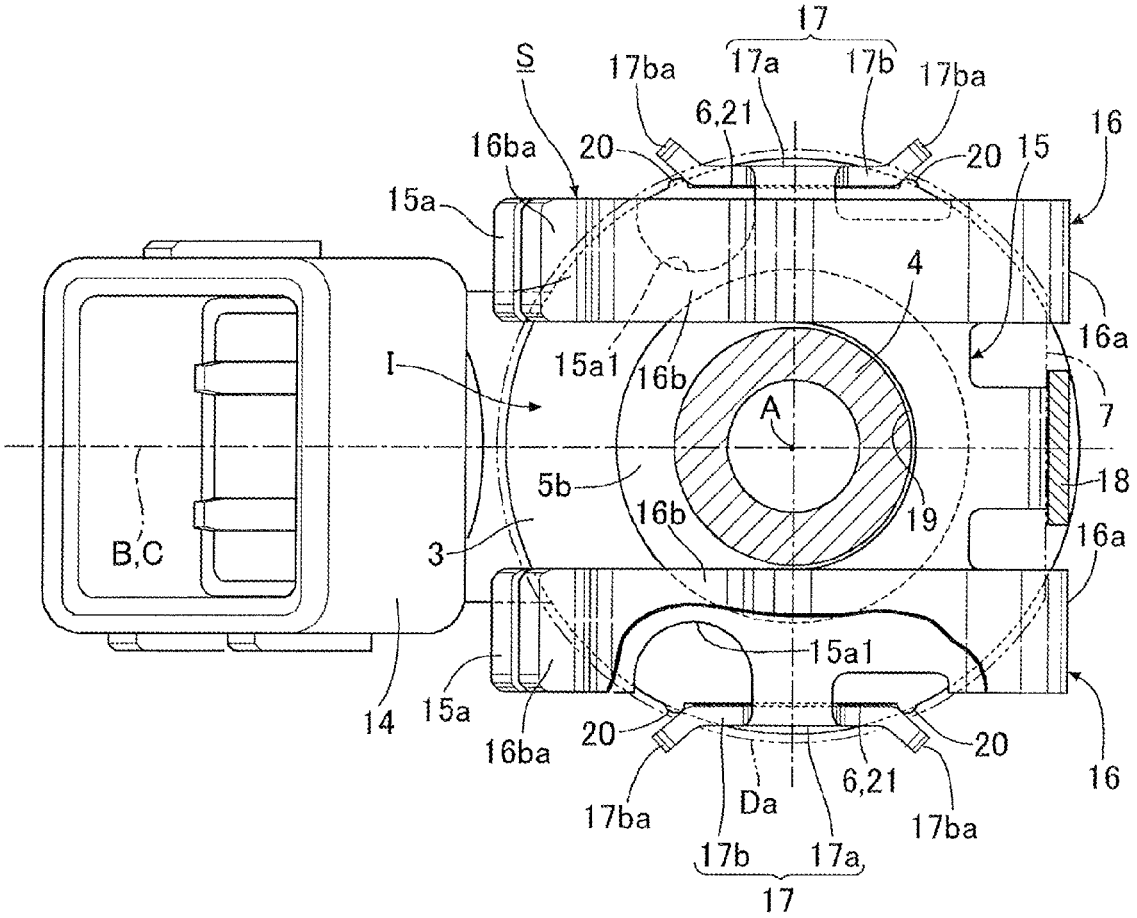
FIG. 3 is a sectional view taken along line 3-3 in FIG. 2.
Figure 4:
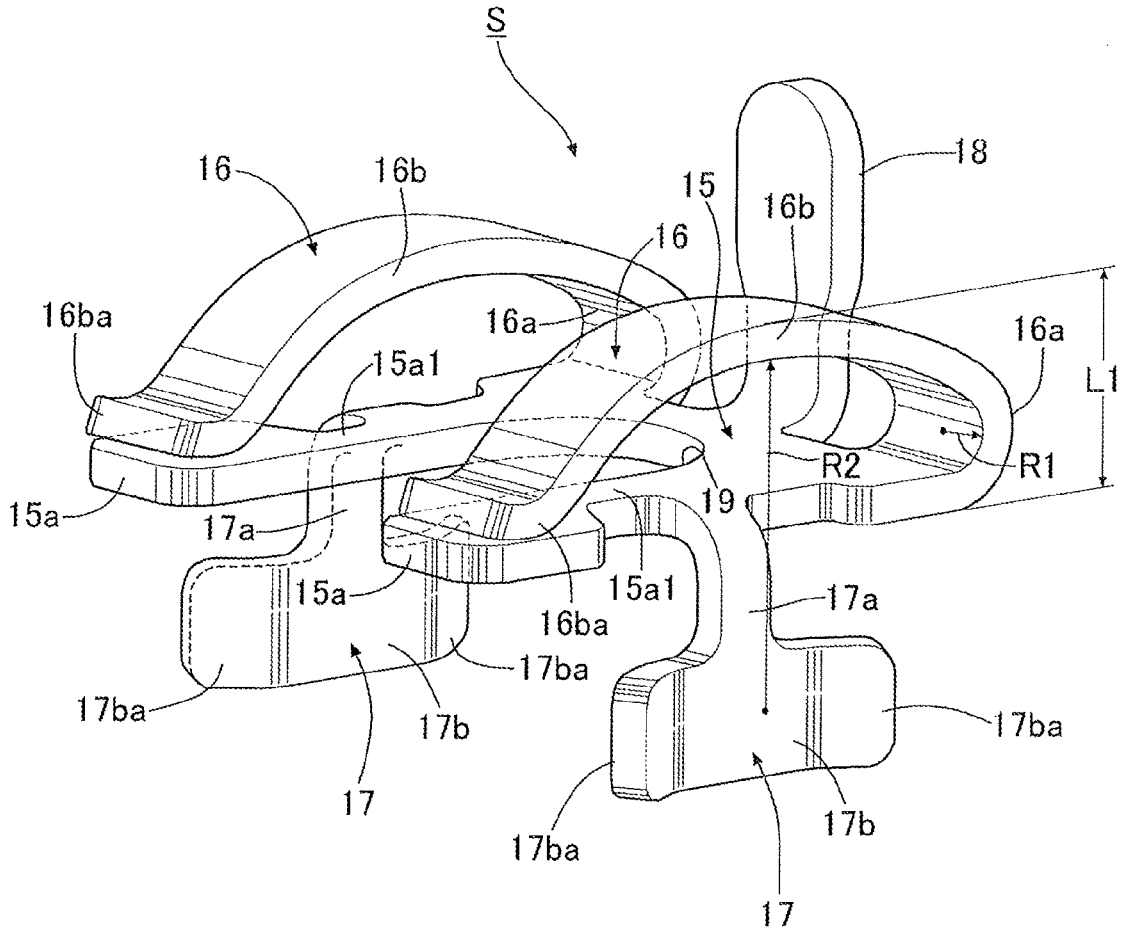
FIG. 4 is a perspective view of only an elastic support member in FIGS. 1 to 3.

As shown in FIGS. 2 to 4, the elastic support member S is obtained by pressing a spring steel sheet, and includes a base plate 15, a pair of elastic pieces 16, a pair of rotation locking pieces 17, and a positioning piece 18.

The base plate 15 is designed to be placed on top of the second load receiving portion 5*b*, and has a U-shaped cutout 19 in a center portion thereof through which the fuel introducing part 4 of the fuel injection valve I can be received. Overhang portions 15*a* which overhang from the second load receiving portion 5*b* are provided at an end portion of the base plate 15 on an opening side of the cutout 19. Moreover, in each overhang portion 15*a*, a narrow portion 15*a*1 with a reduced width is formed near the second load receiving portion 5*b*.

The pair of elastic pieces 16 are molded in such a way as to be integrally joined to one end of the base plate 15 on an opposite side from the U-shaped cutout 19. The elastic pieces 16 are capable of elastically coming into pressure contact with a front end surface of the fuel supply cap Da. These two elastic pieces 16 are disposed with a gap therebetween through which the fuel introducing part 4 of the fuel injection valve I can be received.

Each elastic piece 16 includes: a first elastic portion 16*a* curving upward in a sideways U-shape from the one end of the base plate 15; and a second elastic portion 16*b* extending from this first elastic portion 16*a* toward the other end of the base plate 15 while curving upward, and having a tip end portion 16*ba* in contact with an upper surface of a tip end portion of one of the overhang portions 15*a*. An apex portion of the second elastic portion 16*b* comes into pressure contact with the front end surface of the fuel supply cap Da. A curvature radius R2 of the second elastic portion 16*b* is set sufficiently larger than a curvature radius R1 of the first elastic portion 16*a* (see FIG. 4).

Moreover, in a free state of the elastic piece 16, a distance L1 from the apex of the second elastic portion 16*b* to a lower surface of the base plate 15 (see FIG. 4) is set larger than a distance L2 from the second load receiving portion 5*b* to the front end surface of the fuel supply cap Da (see FIG. 2).

Further, the overhang portion 15*a* starts bending forward at the narrow portion 15*a*1 upon receipt of a forward load of a predetermined value or larger from the elastic piece 16 side.

The tip end portion 16*ba* of the second elastic portion 16*b* is capable of sliding on an upper surface of the overhang portion 15*a* during the bending of the first and second elastic portions 16*a*, 16*b*. The tip end portion 16*ba* is formed in a shape curling in a direction away from the base plate 15, i.e. upward so as to make the sliding movement smooth.

The pair of rotation locking pieces 17 are integrally joined to opposite outside surfaces of the base plate 15, respectively. Each rotation locking piece 17 is formed in an inverted T-shape with a vertical portion 17*a* curving and extending downward from the outside surface of the base plate 15, and a horizontal portion 17*b* extending from a lower end of this vertical portion 17*a* along the U-shaped cutout 19. The pair of rotation locking pieces 17 are capable of clamping the electromagnetic coil part 3 by bringing their horizontal portions 17*b* into engagement with the positioning grooves 21 on the first contact surfaces 6, respectively. To perform this clamping in an elastic manner, a root of each vertical portion 17*a* is given elasticity that biases the horizontal portion 17*b* inward. Moreover, opposite end portions 17*ba* of the horizontal portion 17*b* are formed to curl outward. Thus, the horizontal portion 17*b* can be smoothly moved over the restricting protrusions 20 on opposite sides of the positioning groove 21 so as to be engaged with the positioning groove 21.

Further, the positioning piece 18 standing upward vertically from between the pair of elastic pieces 16 is integrally joined to the one end of the base plate 15. This positioning piece 18 is capable of coming into contact with the second contact surface 7 of the fuel supply cap Da.

Next, operations of this embodiment will be described.

To attach each fuel injection valve I to the engine E, firstly, the elastic support member S is held with an opening of the U-shaped cutout 19 in the base plate 15 facing the fuel injection valve I, and is mounted to the fuel injection valve I from the opposite side from the coupler 14, so that the base plate 15 is set on the second load receiving portion 5*b*, and the rotation locking pieces 17 are elastically engaged with the positioning grooves 21 on the first contact surfaces 6. In this way, each rotation locking piece 17 is prevented from tilting within the positioning groove 21 by the restricting protrusions 20 on the opposite sides of the positioning groove 21. As a result, an assembly is formed in which an attached posture of the elastic support member S to the fuel injection valve I is stable.

Thereafter, the nozzle part 2 of the fuel injection valve I thus assembled is inserted into each injection-valve mounting hole 10 in the cylinder head Eh, so that the cushion member 8 in tight contact with the first load receiving portion 5*a* of the electromagnetic coil part 3 is housed in the concave portion 11. Then, each fuel supply cap Da of the fuel distribution tube D is fitted onto the outer periphery of the fuel introducing part 4 of the fuel injection valve I, and the apex portion of each elastic piece 16 of the elastic support member S is pressed with the front end surface of the fuel supply cap Da to apply a set load (compressive load) thereto. In addition, the bracket Db of the fuel supply cap Da is fastened to the support column 12 of the cylinder head Eh with the bolt 13, so that the distance from the apex of each second elastic portion 16*b* to the lower surface of the base plate 15 is reduced from the distance L1 (FIG. 4) to the distance L2 (FIG. 2).

Upon receipt of the set load at the first and second load receiving portions 5*a*, 5*b*, the fuel injection valve I is elastically clamped between the cylinder head Eh and the elastic support member S, and also the positioning piece 18 is brought into contact with the second contact surface 7 of the fuel supply cap Da.

Here, as mentioned earlier, each rotation locking piece 17 has been prevented from tilting within the positioning groove 21 by the restricting protrusions 20 on the opposite sides of the positioning groove 21, and has been held in proper engagement with the positioning groove 21. Therefore, the positional relation between the fuel supply cap Da fitted on the fuel introducing part 4 and the elastic support member S is maintained constant. Accordingly, the pressing of the fuel supply cap Da against the elastic support member S can be performed accurately.

Meanwhile, each positioning groove 21 is defined between the pair of restricting protrusions 20 protruding from the corresponding first contact surface 6 and arranged thereon side by side with a gap in between. Thus, the positioning groove 21 can be formed on the first contact surface 6 without having to reduce a thickness of a sidewall of the electromagnetic coil part 3 corresponding to the first contact surface 6.

Figure 5:
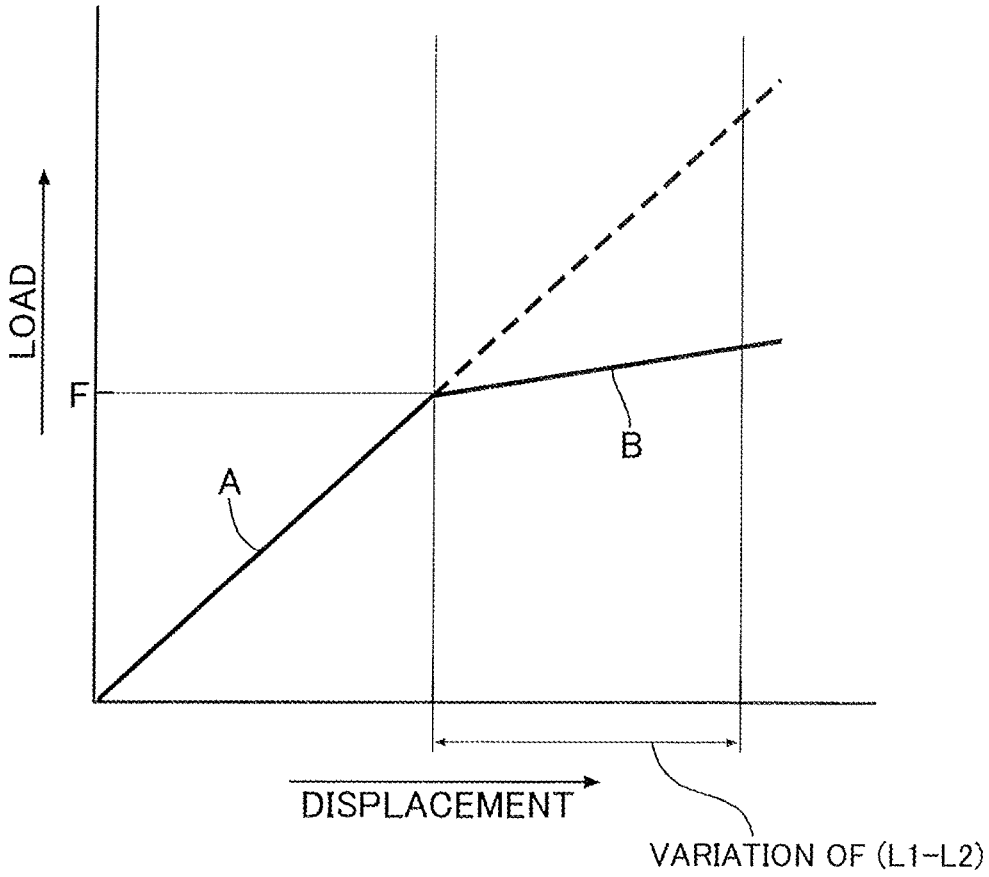
FIG. 5 is a diagram of spring characteristics of the elastic support member.

As shown by line A in FIG. 5, the elastic support member S is such that, the load of each elastic piece 16 increases according to its deformation by pressing force from the fuel supply cap Da, and that load is transmitted from a tip end portion 16*ba* of the elastic piece 16 to the overhang portion 15*a*. Then, as the load reaches or exceeds a predetermined value F (FIG. 5), the overhang portion 15*a*, particularly the narrow portion 15*a*1 of the base plate 15 starts bending, so that a tip end portion of the overhang portion 15*a* descends forward together with the tip end portion 16*ba* of the elastic piece 16. Consequently, an increase in the load to be applied to the elastic piece 16 slows down as shown by line B in FIG. 5. Accordingly, by causing the overhang portion 15*a* to bend already when the fuel supply cap Da is fixed to its preset position, that is, when the bracket Db is fastened to the support column 12, a substantially constant set load can be applied to the elastic support member S even if the amount by which the fuel supply cap Da is pressed against the elastic support member S may slightly vary, due to the position at which the fuel supply cap Da is fixed, and manufacturing errors in portions which support the first load receiving portion 5*a* of the fuel injection valve I, or the like. Thereby, the fuel injection valve I can be held always in a stably supported state.

Moreover, each elastic piece 16 includes: the first elastic portion 16*a* having the small curvature radius R1 and joined to one end portion of the base plate 15; and the second elastic portion 16*b* having the large curvature radius R2 and extending from the first elastic portion 16*a* to bring the tip end portion 16*ba* into slidable contact with the upper surface of the other end portion of the base plate 15. This allows the second elastic portion 16*b* to be supported on the base plate 15 at both ends via the tip end portion 16*ba* and the first elastic portion 16*a*. Thus, stress produced in each elastic piece 16 when the elastic support member S is set is distributed to the first and second elastic portions 16*a*, 16*b*, thereby making it possible to alleviate stress concentration that is likely to occur particularly in the first elastic portion 16*a* having the small curvature radius R1. Accordingly, it is possible to maintain the predetermined set load of the elastic piece 16 for a long period of time and stabilize the support of the fuel injection valve I.

Moreover, if by any chance the first elastic portion 16*a* with the small curvature radius R1 undergoes plastic deformation, the biasing function of the elastic piece 16 against the fuel supply cap Da can be maintained by an elastic force of the second elastic portion 16*b* supported at both ends, thereby causing no problem in supporting the fuel injection valve I.

Moreover, since the curvature radius R2 of the second elastic portion 16*b* is set larger than the curvature radius R1 of the first elastic portion 16*a*, a height of the elastic piece 16 is minimized. Accordingly, the elastic support member S can be easily mounted into a narrow space between the second load receiving portion 5*b* and the fuel supply cap Da.

Although an embodiment of the present invention has been described hereinabove, the present invention is not limited thereto, and various design changes can be made without departing from the gist of the present invention. For example, the positioning groove 21 may be defined on only one of the pair of first contact surfaces 6. Moreover, the positioning groove 21 may be formed by digging the first contact surface 6. Furthermore, the present invention may be applied to a structure in which each fuel injection valve I is attached to an intake system of an engine.

What is claimed is:

1. A support structure for a fuel injection valve in which a nozzle part in a front end section of the fuel injection valve is fitted in an injection-valve mounting hole in an engine, and a fuel supply cap of a fuel distribution tube supported on the engine is fitted on a fuel introducing part in a rear end section of the fuel injection valve, the fuel injection valve having a first load receiving portion and a second load receiving portion along an axial direction thereof, the first load receiving portion being supported on the engine, the second load receiving portion being supported on an elastic support member which receives a set load from the fuel supply cap, wherein:

a pair of contact surfaces are formed on an intermediate portion of the fuel injection valve in such a way as to be opposite to each other with a plane therebetween, the plane including a center axis of the fuel injection valve and a center line of a coupler protruded from one side of the fuel injection valve, the elastic support member comprises:

a base plate placed on the second load receiving portion, an elastic piece extending from the base plate, elastically coming into pressure contact with the fuel supply cap, and biasing the fuel injection valve against the engine by using a reaction force resulting from the contact, the elastic piece having a tip end portion which is placed in slidable contact with an upper face of the base plate, a pair of rotation locking pieces extending from the base plate and coming into contact with the contact surfaces respectively to restrict rotation of the fuel injection valve about the center axis, and a single positioning piece extending upward from one end of the base plate and configured to abut against the fuel supply cap, each of the rotation locking pieces comprises a vertical portion curving and extending downwardly from an outside surface of the base plate and a horizontal portion extending from a lower end of the vertical portion, each the horizontal portion having opposite end portions thereof formed to curl outward, at least one of the contact surfaces of the fuel injection valve is formed with a pair of restricting protrusions which are disposed side by side with a gap therebetween, these restricting protrusions defining a positioning groove, and the opposite end portions of the horizontal portion of the rotation locking piece are placed in resilient engagement with the restricting protrusions defining the positioning groove, respectively.

2. The support structure for a fuel injection valve according to claim 1, wherein each of the pair of rotation locking pieces is formed in an upside down T-shape with the vertical portion curving and extending downwardly from the base plate, and the horizontal portion extending from the lower end of the vertical portion.

* * * * *